US007794220B2

(12) United States Patent
Suzuki

(10) Patent No.: US 7,794,220 B2
(45) **Date of Patent: *Sep. 14, 2010**

(54) APPARATUS FOR MANUFACTURING ORIENTED SHEATH-CORE TYPE FILAMENTS

(75) Inventor: Akihiro Suzuki, Kai (JP)

(73) Assignee: University of Yamanashi, Yamanashi (JP)

( * ) Notice: Subject to any disclaimer, the term of this patent is extended or adjusted under 35 U.S.C. 154(b) by 1043 days.

This patent is subject to a terminal disclaimer.

(21) Appl. No.: 10/548,991

(22) PCT Filed: Mar. 5, 2004

(86) PCT No.: PCT/JP2004/002864

§ 371 (c)(1),
(2), (4) Date: Sep. 6, 2005

(87) PCT Pub. No.: WO2004/085723

PCT Pub. Date: Oct. 7, 2004

(65) Prior Publication Data

US 2006/0182960 A1 Aug. 17, 2006

(30) Foreign Application Priority Data

Mar. 7, 2003 (JP) ..... 2003-107089

(51) Int. Cl.
*D02J 1/22* (2006.01)

(52) U.S. Cl. ..... 425/66; 264/481; 425/72.2; 425/174.4

(58) Field of Classification Search ..... 425/66, 425/72.2, 174.4; 264/481
See application file for complete search history.

(56) References Cited

U.S. PATENT DOCUMENTS

| | | | | |
|---|---|---|---|---|
| 5,698,146 | A * | 12/1997 | Schippers et al. | 264/103 |
| 6,497,952 | B1 * | 12/2002 | Ohkoshi et al. | 428/364 |
| 7,101,504 | B2 * | 9/2006 | Suzuki | 264/481 |
| 2007/0222104 | A1 * | 9/2007 | Sukuzi | 264/204 |

FOREIGN PATENT DOCUMENTS

| | | |
|---|---|---|
| JP | 49-81621 | 8/1974 |
| JP | 60-24852 | 2/1985 |

(Continued)

OTHER PUBLICATIONS

Appliation of CO2 Laser Heating Zone Drawing and Zone Annealing to Nylon 6 Fibers Akihiro Suzuki, Masayoshi Ishihara Journal of Applied Polymer Science, Vol. 83, pp. 1711-1716 Feb. 22, 2002.

(Continued)

*Primary Examiner*—Yogendra N Gupta
*Assistant Examiner*—Joseph Leyson
(74) *Attorney, Agent, or Firm*—Jordan and Hamburg LLP

(57) ABSTRACT

The object of this invention is to make possible the manufacturing of sheath-core type super microfilaments from sheath-core type filaments such as hollow filaments, optical filaments and conjugate filaments continuously and stably by a simple and convenient means without requiring any apparatus of high-accuracy and high-level, characterized in that original filaments delivered from sheath-core type filament supply means are heated by infrared beams and the heated sheath-core type filaments are drawn at 100 times or more by a tension provided by the own weight or under a tension of 1 MPa or less.

6 Claims, 10 Drawing Sheets

FOREIGN PATENT DOCUMENTS

| | | | | |
|---|---|---|---|---|
| JP | 02251670 | A | * | 10/1990 |
| JP | 4-272217 | | | 9/1992 |
| JP | 04272217 | A | * | 9/1992 |
| JP | 7-258940 | | | 10/1995 |
| JP | 07278943 | A | * | 10/1995 |
| JP | 11-21737 | | | 1/1999 |
| JP | 2001-279519 | | | 10/2001 |
| JP | 2001-348727 | | | 12/2001 |
| JP | 2002-13021 | | | 1/2002 |
| JP | 2002-115117 | | | 4/2002 |
| JP | 2002-161451 | | | 6/2002 |
| JP | 2002-220740 | | | 8/2002 |
| JP | 2003-166115 | | | 6/2003 |
| JP | 2004-107851 | | | 4/2004 |
| WO | WO- 00/73556 | | | 12/2000 |

OTHER PUBLICATIONS

Polymer Preprints, Japan Application of High Power CO2 Laser Vol. 50, No. 4, p. 787, (2001), Heating Zone Drawing to PET Fibers Mechanical Properties and Microstructrure of PET Fibers obtained by Laser-Heating Zone-Drawing [III] Akihiro Suzuki and Noriaki Mochiduki, Faculty of Engineering, Yamanashi University pp. 105-106.

PET Microfiber Prepared by Carbon Dioxide Laser Heating Akihiro Suzuki, Noriaki Mochizuki Journal of Applied Polymer Science, vol. 88, pp. 3279-3283 Jun. 28, 2003.

Mechanical Properties and Microstructure of Poly(ethylene terephthalate) Microfiber Prepared by Carbon Dioxide Laser Heating Akihiro Suzuki, Noriaki Mochizuki Journal of Applied Polymer Science, vol. 90, pp. 1955-1958 Nov. 14, 2003.

* cited by examiner (A)

FIG. 8

Outside Diameter and Inside Diameter ($\mu$ m) by Drawing of Hollow Filaments

| Wind-up Speed | Supply Speed (m/min) | | | | | |
|---|---|---|---|---|---|---|
| | 0.3 | | 0.45 | | 0.6 | |
| (m/min) | OD | ID | OD | ID | OD | ID |
| 84.8 | 14.5 | 3.7 | 19.5 | 6.0 | 20.0 | 3.0 |
| 169.6 | 10.0 | 2.0 | 14.5 | 4.0 | 15.0 | 2.8 |
| 254.5 | 9.0 | 2.0 | 9.0 | 1.6 | 11.0 | 1.5 |
| 339.3 | 8.0 | 1.8 | 9.0 | 1.5 | 10.0 | 1.2 |
| 425.1 | 7.0 | 1.6 | 8.0 | 1.0 | 7.0 | |

OD: Outside Diameter, ID: Inside Diameter

A

B

APPARATUS FOR MANUFACTURING ORIENTED SHEATH-CORE TYPE FILAMENTS

1. FIELD OF THE INVENTION

This invention concerns a method of and an apparatus for manufacturing drawn sheath-core type filaments and it especially relates to sheath-core type super microfilaments such as hollow super microfilaments, optical super microfilaments, conjugate super microfilaments drawn at a high draw ratio of 100 times or more and obtained by the simple and convenient drawing method.

2. BACKGROUND OF THE INVENTION

Super microfilaments have been used in various applications such as artificial leathers, wiping cloths and filters. However, since special and complicated spinning methods such as island-in-sea type fiber spinning (for example, Japanese Patent Laid-Open No. Hei 7-258940) or spinning by dividual fibers (for example, Japanese Patent Laid-Open 2002-220740) have been used, for the production of highly molecular oriented super microfilaments and having high quality with the fiber diameter of 5 μm or less, they are expensive and cannot be drawn simply and conveniently by using general purpose fibers.

As a method of drawing to obtain fibers with high tensile strength and high tensile modulus, the present inventors, et al. have proposed a zone drawing method (Japanese Patent Publication No. Sho 60-24852), but further requirements are desirable for stable production of fine filaments by the zone drawing.

And, the request to produce super micro fibers in the field of fibers are extended to fibers having higher function and performance. However, it is difficult to produce at stable operation as the apparatus is more complicated and precise so that is expensive by the conventional method to obtain super micro fibers. And the manufacturing methods of the conventional super micro fibers are not match the production of high performance fibers as their production is high-mix low-volume production that it has been required the manufacturing means of high performance fibers of high quality in more simple and convenient ways. Therefore, the simple and convenient method is required also in sheath-core type super microfilaments which are the typical example of high performance fibers.

On the other hand, this invention concerns drawing technology of filaments by infrared rays heating but the technology regarding these has been performed in many ways conventionally (for example, Japanese Patent Laid-Open 2003-166115, pamphlet of International Laid-Open No. 00/73556, Akihiro Suzuki, et al. "Journal of Applied Polymer Science", Vol. 83, 1711-1716, 2002, Akihiro Suzuki and one other, Preliminary Abstracts of Polymer Science Society, Japan, May 7, 2001, Vol. 50, No. 4, pp. 787, Akihiro Suzuki and one other, "Journal of Applied Polymer Science", Vol. 88, pp. 3279-3283, 2003, Akihiro Suzuki and one other, "Journal of Applied Polymer Science", Vol. 90, pp. 1955-1958, 2003). Improving these technologies further, this invention is made effectively applicable to the sheath-core type filaments.

3. DISCLOSURE OF THE INVENTION

Problems to be Solved by the Invention.

This invention is further developed on the above conventional technology and the object is to obtain easily sheath-core type super microfilaments by simple and convenient method without the need of special, high-accuracy and high-level apparatus. And the other object is to enable stable manufacturing of sheath-core type filaments such as hollow filaments, optical filaments and conjugate filaments in high quality and fine diameters of filaments. Moreover, the other object is to provide sheath-core type filaments in which a drawn portion of the drawn hollow super microfilaments, drawn optical super microfilament and the like and un-drawn original filaments are connected in a unified manner. Further, the other object is to enable the manufacturing of long fiber non-woven fabrics consisting of sheath-core type filaments such as hollow supper microfilaments and conjugate super microfilaments.

Means to Solve the Problems

This invention has been accomplished to achieve foregoing objects and the characteristics as the manufacturing method are shown below. This invention concerns a manufacturing method of the sheath-core type filaments which are provided an applied tension of 10 MPa or less and are drawn at the draw ratio of 100 times or more by heating with infrared beams. Also this invention relates to a manufacturing method of drawn sheath-core type filaments in which said tension is provided by the own weight of the original sheath-core type filaments. And this invention concerns a manufacturing method of the drawn sheath-core type filaments in which the said infrared beams are irradiated within up-and-down 4 mm or less of axial direction at the center of the original sheath-core type filaments and are the irradiation from at least 2 directions or more. Also this invention concerns a manufacturing method of the drawn sheath-core type filaments in which said infrared beam is a laser beam. And this invention concerns a manufacturing method of the drawn sheath-core type filaments in which said original sheath-core type filaments are delivered by blowing ducts and guided to said infrared beams. Also this invention relates to a manufacturing method of the drawn sheath-core type filaments in which said original sheath-core filaments are equipped with a guiding tool to restrict the position of the original sheath-core type filaments before said original sheath-core type filaments are heated by the infrared beams. And this invention concerns a manufacturing method of drawn sheath-core type filaments in which the drawn sheath-core type filaments are connected to the original sheath-core type filaments are obtained by stopping the infrared irradiation during said drawing process and taking out the products in the situation that oriented filaments have been connected to the original sheath-core type filaments. Also this invention relates to a manufacturing method of drawn sheath-core type filaments in which the said drawn sheath-core type filaments are heated by a zone heater described below. And this invention concerns a manufacturing method of drawn sheath-core type filaments in which said drawn sheath-core type filaments are further drawn. Also this invention relates to a manufacturing method of drawn sheath-core type filaments in which plural numbers of the drawn sheath-core filaments reeled off simultaneously are further drawn and wound-up in a unified manner. And this invention relates to a manufacturing method of non-woven fabrics consisting of the drawn sheath-core type filaments in which said drawn sheath-core type filaments are collected on a running conveyer. Further, this invention relates to a drawing starting method of the drawn sheath-core type filaments in which said original filaments are drawn with tension provided by the own weight and then drawn by predefined wind-up speed in a manufacturing method of said drawn sheath-core type filaments.

Also this invention is conducted to achieve the above objects and the features as a manufacturing apparatus are shown in the following. This invention concerns a manufacturing apparatus of drawn sheath-core type filaments which have a supply device of the original filaments consisting of the sheath-core type filaments, an infrared ray heating device that are composed to heat within up-and-down 4 mm of axial directions at the center of the original filaments by the irradiation of the infrared beams from plural spots (directions) and the means to control the heated original filaments to be drawn 100 times or more by providing an applied tension of 10 MPa or less. And this invention relates to a manufacturing apparatus of the drawn sheath-core type filaments in which said infrared beam is a laser beam radiated by a laser emitter. Also this invention relates to a manufacturing apparatus of drawn sheath-core type filaments in which the radiation means from plural directions of said infrared beams are ones reflecting the irradiated beam from one direction using mirror. And this invention relates to a manufacturing apparatus of drawn sheath-core type filaments in which the radiation means from plural directions of said infrared beams are the beams from plural infrared beam emitters. Also this invention concerns a manufacturing apparatus of drawn sheath-core type filaments in which the laser is a carbon dioxide gas laser having said a laser power density of 10 W/cm$^2$ or more. Further, this invention relates to a manufacturing apparatus of drawn sheath-core type filaments in which said original sheath-core type filaments are provided with a guiding tool to regulate the position of the sheath-core type filaments before heating by said infrared beams. Also this invention concerns a manufacturing apparatus of drawn sheath-core type filaments in which said guiding tool has a position control device that can finely adjust the guiding position of said original sheath-core type filaments. Further this invention relates to a manufacturing apparatus of the drawn sheath-core filaments in which it is composed that a blowing duct is described above said original sheath-core filaments are heated by said infrared beam and the original sheath-core filaments are delivered by the blowing duct.

Moreover, this invention has been conducted to accomplish foregoing objects and the following shows the features as drawn sheath-core type filaments. This invention concerns drawn sheath-core type super microfilaments in which said drawn sheath-core type filaments are hollow filaments consisting of sheaths only of which insides are gas, and a outer diameter of the drawn hollow filaments are 10 μm or less. Also, this invention relates to the drawn sheath-core type super microfilaments in which said drawn sheath-core type filaments are the hollow filaments for dividual fibers having many cracks in a longitudinal direction of the drawn hollow filaments. Furthermore, this invention concerns drawn sheath-core type super microfilaments in which said drawn sheath-core type filaments are the micro-porous-film hollow filaments having many micro-pores on a wall of the drawn filaments. Also, this invention concerns drawn sheath-core type super microfilaments in which core components of said drawn sheath-core type filaments are consisted of polymers that have light transmittance for main component of 85% or more, and are optical filaments with the filament diameter of 30 μm or less. Moreover, this invention relates to drawn sheath-core type super microfilaments in which core components of the said sheath-core type filaments are quartz series glass or fluoride glass and are optical filaments with a filament diameter of 10 μm or less. Further, this invention relates to the drawn sheath-core type super microfilaments in which said drawn sheath-core type filaments are the conjugate filaments and the sheath components of conjugate filaments consist of adhesive polymers. Also, this invention relates to sheath-core type filaments in which said original sheath-core type filaments and said drawn sheath-core type filaments are the connected optical filaments. Moreover, this invention concerns sheath-core type filaments in which said original sheath-core type filaments and said drawn sheath-core type filaments are the connected hollow filaments.

This invention relates to the drawn sheath-core type filaments. The filaments are the fibers that have substantially continuous length and are distinguished from staple fibers that consist of short length (from several millimeters to several centimeters). The sheath-core type means the filaments that are actively differentiated structure at skin portion and inside core portion in cross sections of filaments. The word "actively" means that it is not included skin structure and so on that spun filaments from homogeneous systems generate at spinning and drawing stages.

The hollow filaments in this invention are formed of sheaths only and cores consist of gases but included in the sheath-core type filaments of this invention. And, in a case filaments have plural hollow portions inside, called a lotus root type; is also included in the sheath-core type filaments of this invention.

The hollow filaments of this invention consist of polymers used as fibers for clothes such as poly(ethylene terephthalate) (PET), polyamide, polypropylene and polyvinyl alcohol and have been used conventionally for the purpose of light weight, heat insulation and thermal retention. But, by making these to super microfilaments simply and conveniently by this invention, performance such as fineness of texture for clothes, improved gloss and printability and possible presentation of water proof property are further increased and these are high-grade and high-quality filaments. Also, the hollow filaments having many cracks for manufacturing the dividual fibers are included as the other example of the hollow filaments. The fibers, divided after drawing, having more fine and complicated cross section can be manufactured by forming super microfilaments simply and conveniently by this invention. Further in this invention, the hollow filaments (micro-porous hollow filaments) that have many micro-pores (pore-size: from several tens angstroms to several micrometers) on walls called hollow fiber membranes (micro-porous-film hollow fibers) are also included. The micro-porous hollow filaments are formed simply and conveniently into the super microfilaments according to drawing of this invention and further thickness of the membrane is reduced and separating efficiency is improved by drawing. And shapes of pores are thin and long by drawing, so the pores are finer that more delicate separation is enabled and performances as gas separation membranes are increased.

The optical filaments consist of cores that are made of high light transmittance materials and sheaths (clad) that are made of the materials of a lower refractive index than the core and are the filaments of sheath-core structure. Though there are organic series and inorganic series in the optical filaments, this invention includes both of them. The optical filaments of this invention have the light transmittance of 85% or more, preferably 88% or more, further preferably 90% or more and the most preferably 92% or more. The lower light transmittance materials than the core component is used for the sheath component. Still, this light transmittance is measured in a visible light range including 200 μm.

The optical filaments of this invention are a thin and long line for transmitting light inside of the filaments, usually also called optical fibers or optical waveguides. The optical filaments normally are the filaments of the sheath-core structure consisting of the core that is made of materials of the high light transmittance and the sheath (clad) that is made of the materials of a lower refractive index than the core. And, for the sheath-core structure, there are step index type in which the core and the sheath are clearly separated and the light advances reflecting at a boundary of the core and the sheath, Greaded Index type in which the central portion of filament has the highest refractive index and it is gradually lowered toward periphery so that the light tried to go out advances gathering at a central portion, single mode type in which the light advances the central portion mainly as the central portion diameter of the core is made 10 μm or less. As this invention can easily manufacture fine diameter filaments from large diameter filaments, especially suitable for manufacturing single mode type filaments from step index type filaments. The drawn optical filaments of this invention improve point by point resolution of an image sensor and the like according to be super microfilaments by drawing and enable an apparatus to be compact as fiber bundles are more flexible and also thin and flat.

The core component of drawn optical filaments of this invention is preferably made of one kind of polymer selected from poly-methyl methacrylate, polycarbonate, polystyrene and poly-trimethyl pentane as the main component. Because these polymers have good light transmittance and high refractive index. The main component means that the component exceeding 50% (weight percent, hereinafter the same); preferably 70% or more and the most preferably 90% or more consists of these polymers. Also, it is possible to use these polymers that are modified with the other chemical species. And, it is characterized in that the sheath component of the optical filaments is a fluorine-containing polymer. The fluorine-containing polymers are low in the refractive index that it is very useful for the sheath component of the optical filaments. The fluorine-containing polymer is referred to the polymers containing 2% or more, preferably 5% or more fluorine atom in it.

In organic series optical filaments of this invention, filament diameters are preferably 30 μm or less, more preferably 20 μm or less and the most preferably 10 μm or less. Conventionally, organic series optical filaments of such small diameter have been difficult to manufacture, but it is characterized in that these can be simply and conveniently manufactured by this invention and that manufacturing of the filaments connected to the original filaments of larger diameter is also possible.

As inorganic series optical filaments of this invention, it is characterized in that the core components are quartz glass or fluoride glass. The quartz glass is preferred in long distance communication and the fluoride glass is further preferred in high performance field.

In this invention, various kinds of conjugate filaments spun from conjugate spinning dies are also included. The conjugate filaments are also called composite filaments (or composite fibers). As an example of the conjugate filaments of this invention includes filaments of which the core is strength member polymers such as polyethylene terephthalate, nylon and polypropylene and the sheath is an adhesive layer consisting of polymers that have lower melting point than the core such as modified polyester, modified polyamide or modified polyolefin, that these filaments have adhesiveness. And as the other example of conjugate filaments, there are also hygroscopic filaments in which the cores are the foregoing strength member polymers and the sheaths consist of layers of polymers having hygroscopic properties such as polyamide and polyvinyl alcohol. Moreover, the conjugate filaments are used also for filaments generating crimp by unevenly distributing the position of the core from the center of the cross section and generate shrink after drawing. Although these conjugate filaments have been used conventionally, their performances are further improved and make them high-grade and high-quality ones by being super microfilaments simply and conveniently by this invention.

This invention provides means for drawing of the original sheath-core type filaments. The original sheath-core type filaments in this invention may be already manufactured as the sheath-core type filaments and wound-up on bobbins and the like, or sheath-core type filaments to be the material for the drawing means in this invention which are formed into the sheath-core type filaments from molten or dissolved sheath-core type filaments by cooling or coagulation in the spinning process, and used successively in the spinning process.

The original sheath-core type filaments of this invention are heated to an appropriate temperature for drawing by infrared beams irradiated from infrared heating means (including a laser). The infrared rays heat the original sheath-core type filaments but the range to be heated to an appropriate temperature for drawing is heated preferably within up-and-down 4 mm in axial directions of the filaments at the center the original sheath-core type filaments, further preferably 3 mm or less and the most preferably 2 mm or less. This invention enables the drawing with high molecular orientation by the rapid drawing in the narrow region and that it is possible to decrease breakage of drawing even in the super high drawing ratio. Yet, the irradiation of infrared beams in this case shall preferably be irradiated from plural directions. Because the originally difficult to draw filaments by asymmetry heating of the sheath-core type filaments, the heating from one side only of filaments make it more difficult to draw. If the original filaments are the hollow filaments, heating from one side only especially make it difficult to draw by its thermal insulation property. Such irradiation from plural directions can be achieved by the irradiation of plural times along a passage of the original filaments by reflecting the infrared beam with mirrors. The mirrors of rotating type, not only fixed types, such as polygon mirrors can be used.

And as the other means of irradiation from plural directions, there are means to irradiate light sources from plural light sources to the original filaments from plural directions. It is possible to be the high powered light sources by using plural laser emitters which are relatively small laser light sources and are stable and not expensive, that the method of using plural light sources is useful as the sheath-core type filaments of this invention need high watt density.

The wave length of the infrared rays is said to be from 0.78 μm to 1 mm but a near infrared region about from 0.78 μm to 20 μm centering on the absorption at 3.5 μm for C—C bonds of polymeric compound is particularly preferred. For the infrared rays, heating heaters referred to a spot heater or a line heater of narrowing the focal point into a line or spot shape by a mirror or a lens thereby narrowing the heating area for the sheath-core type filaments to up-and-down 4 mm or less in an axial direction can be used. Particularly, the line heater is suitable in a case of heating the plural sheath-core type filaments simultaneously.

For the infrared heating in this invention, laser heating is particularly preferred. Among all, a carbon dioxide gas laser with a wave length of 10.6 μm and a YAG (Yttrium-Aluminum-Garnet series) laser with a wavelength of 1.06 μm are particularly preferred. Also, an argon gas laser can be use. Since the laser can restrict the radiation range smaller and the energy is concentrated to a specified wavelength, wasteful energy is decreased. The carbon dioxide gas laser of this invention has the power density of 10 W/cm$^2$ or more, preferably 15 W/cm$^2$ or more, further preferably 20 W/cm$^2$ and the most preferably 30 W/cm$^2$ or more. This is because the super high ratio drawing of this invention is enabled by concentrating the high power density energy to a narrow drawing region. Still, in this invention, although the original filaments are irradiated from the plural directions, the power density from each direction is added and shown in this case.

Generally, the drawing is carried out by heating the sheath-core type filaments and the like to an appropriate drawing temperature and applying a tension thereon. The applied tension in drawing of this invention, characterized in that drawing is conducted by the tension provided by the own weight of filaments. This is different in the principle, from usual drawing where drawing is conducted by the tension provided by the difference of speeds between rollers and by the tension caused by wind-up. In this invention, an optimal applied tension can be selected by changing the own weight of the sheath-core filaments applied to the heated portion (determined depending on the free falling distance from the heated portion) by the change of the free falling distance. In the usual drawing between rollers, it is difficult to control the draw ratio as large as 100 times or more. It is the feature of this invention that the ratio can be controlled easily by a simple and convenient means of distance. Such the tension by the own weight can be obtained by the range of 10 Mpa or less shown in the following.

Further, the tension in this invention is extremely reduced level, and the drawing is conducted by setting an applied tension to 10 MPa or less, preferably 3 MPa or less, further preferably 1 Mpa or less and the most preferably 0.3 MPa or less. If the applied tension exceeds 10 Mpa, the breakage at the drawing is liable to occur and the range of the applied tension as described above is preferred for drawing at a high draw ratio. With such small drawing tension, the extremely high drawing ratio such as 100 times or more, depending on the condition 1000 times or more or 10,000 times or more can be realized. Because, drawing is conducted within an extremely narrow drawing region while keeping an extremely high drawing temperature of the melting point or thereabout, so that the sheath-core type filaments can be deformed with no breakage. In the usual drawing for synthetic fibers between rollers, the fibers are drawn at an applied tension of several ten MPa to several hundred MPa. The feature of this invention resides in drawing within a range greatly different therefrom.

In this invention, it is characterized in that the filaments are drawn at a super high ratio of the obtained drawn sheath-core type filaments as 100 times or more, preferably 200 times or more, further preferably 500 times or more and the most preferably 1,000 times or more are conducted. Considering that the draw ratio of a usual synthetic fiber is 3 to 7 times, and even in super drawing of PET fibers, it is about ten and several times. Especially in functional fibers such as hollow fibers and optical filaments, conjugate filaments and the like, drawing of the super high draw ratio like this invention is not conducted as there is possibility to damage the function of filaments in such the super high draw ratio. This invention has a feature in that drawing within an extremely narrow zone is enabled and, accordingly, the drawing temperature can be increased to the melting point or thereabout of the original sheath-core type filaments which decreases the drawing tension, and that means capable of controlling the small drawing tension and the super high draw ratio has been found. Since the drawing at the super high draw ratio is possible, this enables manufacture of the sheath-core type super microfilaments with a diameter of 30 μm or less, further 10 μm or less and further 5 μm or less, as well as increase the production speed for manufacture of the sheath-core type filaments to several hundred times, which is significant in view of the productivity.

In this invention, there is a case that drawing is conducted with a swelled portion larger than the diameter of the original sheath-core type filaments at a drawing starting portion where it is drawn by the infrared beam. Such a peculiar phenomenon has not yet been observed in usual drawing for synthetic fibers. It is considered that the phenomenon is derived from that the drawing temperature is increased to the melting point or thereabout of the original sheath-core type filaments and drawing in the narrow zone is enabled. As described above, by drawing with the swelled portion, it is enabled to draw at a draw ratio of 100 times or more, or 1,000 times or more and in a suitable condition 10,000 times or more.

In a case of heating original sheath-core type filaments in this invention by the infrared beam, continuously drawn filaments are formed by moving the original filaments against the infrared beam. For the moving of the original filaments, two means are provided by this invention. One of them is a method in which original filaments are moved relatively to the infrared beam (batch method) by a transfer device of the gripper, where the original filaments are held with a gripper. The other one is a method in which the original filaments are continuously delivered (continuous method) by a supply means of the original filaments.

In the batch method, the original filaments are held by the gripper and the original filaments move relatively against the infrared beam by the transfer device of the gripper. The gripper may be some kind of a chuck, but there is a case that the gripper is connected to a part of the transfer device. The typical transfer device is a crosshead moved by a rack-and-pinion system, but the device may be simple rotating spiral screw and the like. Also, it is possible to guide to a suitable position of the infrared beam by guiding the original filaments with tackles and so on to move the original filaments easily.

In the continuous method of this invention, drawing is conducted to the original sheath-core type filaments delivered from the supplying means. As for the supply means, various types can be used if these can supply the sheath-core type filaments at constant supplying speed with nip rollers, driven roller groups and the like.

In both the batch and continuous methods, it is preferable to provide a guiding tool which controls the position of the original filaments just before the infrared beam hit original filaments. Depending on the exit shape of a blowing duct of the continuous method it is possible to have such function, but the blowing duct shall focus on air flowing of gas delivering sheath-core filaments and easiness of passing sheath-core type filaments, and after that to control the position of sheath-core type filaments is preferable by the simple and convenient guiding tool. As the guiding tool, a narrow duct or groove, a comb or a combination of fine bars may be used. Also foregoing tackles can achieve roles of the guiding tool of this invention.

The just before position of the infrared beam hitting the original filaments is preferably 100 mm or less, further preferably 50 mm or less and the most preferably 20 mm or less. The heating by infrared beam of the original filaments characterizes in that the heating is conducted extremely narrow range and the position of sheath-core type filaments are required to be restricted for enabling the heating of the narrow range. Although the guiding tool is not required in conventional ordinary drawing as the drawing tension is large, but in this invention as the drawing tension is small and the drawing ratio is large, and very little fluctuation and variation of the drawing point affect the stability of the drawing that to provide the guiding tool just before the drawing point greatly contributes to the stability of drawing. The guiding tools for this invention, a narrow duct and groove, a comb or a combination of fine bars may be used.

In the above guiding tools, it is desirable to have a position control mechanism to be able to adjust finely the position of the guiding tool. For precisely fitting a running position of filaments to a narrow region of laser beam, the guiding tool shall necessary be controlled the position in XY directions.

The original sheath-core type filament delivered by the supplying means of filaments are desirable to be delivered further through the blowing duct by a gas flowing the running direction of the original sheath-core type filament in the blowing duct. As for the gas flowing in the blowing duct, the gas of room temperature is used usually but when pre-heating of the original sheath-core type filaments is desired, heated air is used. And if the original sheath-core type filaments are prevented to be oxidized an inert gas such as nitrogen or the like is used and if scattering of water is protected a gas containing water vapor or water is used. Still, the blowing ducts shall not necessary be a tubular shape but being a groove shape, if original sheath-core type filaments can flow together with the gas through in these. The cross section of the duct is preferably circular but may be rectangular or other shape. The gas flow through the duct may be supplied from one of a branched ducts, or may be supplied from an outer duct to an inner duct through apertures and the like using a double walled duct. An air jet interlacing nozzle for filaments used for interlace spinning or Taslan fabrication of synthetic fibers is also used for the blowing duct in this invention. And in a case of drawing by free falling as non-woven fabrics manufacturing in this invention, filaments may be provided the drawing tension by air momentum according to the blowing duct of this invention.

In drawing of the sheath-core type filaments in this invention, it is characterized in that plural numbers of the original sheath-core type filaments are gathered together and can be drawn in the same infrared beam. Usually, if the plural numbers of original filaments are drawn together, agglutination among the drawn filaments occurs but the sheath-core type filaments can be drawn without the agglutination depending on composition of the sheath component. For example, it is such a case that the sheath components of the optical filaments are fluorine series polymers. And, by the guiding tool just before the drawing point, it can be made also not to contact among plural filaments at the drawing point. The plural numbers of filaments mean that the drawing could be conducted for 2 or more and in some cases even 5 or more filaments.

The drawn sheath-core type filaments of this invention are wound-up around a bobbin or cheese in a following process into products of bobbin-wound or cheese-wound form. In these wind-up processes, the drawn sheath-core type filaments are preferably wound-up while being traversed. This is because uniformly wound-up form can be ensured by traversing. In the sheath-core type super microfilaments, occurrences of breakage of filaments or fluff result in a most significant problem. In this invention, since the filaments are highly molecular oriented and the drawing tension is small, the filaments can be wound-up with a small winding tension, it is characteristics of this invention to decrease also occurrences of breakage of filaments or fluff. Yet, when the plural filaments are drawn and wound-up simultaneously it is possible to wind-up twisting by a twister but it is preferable to wind-up entwining among filaments by an interlace method as running speed of the filaments of this invention is fast.

Subsequent to the drawing step of this invention, a heating device having a heating zone may be disposed to apply a heat treatment to the drawn sheath-core type filaments. Heating can be conducted by passing them through a heating gas, radiation heating such as infrared ray heating, passing them over a heating roller, or a combination of them. The heat treatment can provide various effects such as reduction of thermal shrinkage of the drawn sheath-core filaments, increase in the degree of crystallinity to decrease the aging change of the sheath-core type filaments or improve the Young's modulus. In the case of non-woven fabrics of this invention, the heat treatment may also be applied on a conveyor.

The drawn sheath-core type filaments of this invention can be wound-up after additional drawing. For the drawing in the subsequent step, drawing means by the infrared ray used in the previous step can also be used. In a case where the filament has already been drawn at a sufficiently high draw ratio in the previous step and the sheath-core type super microfilaments have already been obtained, inter-roller drawing such as by usual godet rollers, pin drawing and zone drawing may also be used.

Non-woven fabrics consisting of the drawn sheath-core type filaments can be manufactured by accumulating the drawn sheath-core type filaments of this invention on a running conveyor. Especially in this invention, it is significant that non-woven fabrics consisting of the super microfilaments of the hollow filaments and the conjugate filaments can be manufactured simply and conveniently. In recent years, non-woven fabrics have been demanded vigorously in various fields taking notice on the characteristics peculiar to the non-woven fabrics not merely as substitutes for woven fabrics. Among them, non-woven fabrics of super micro fibers include melt blown non-woven fabrics which are prepared by blowing off molten filaments by hot blow to form filaments of 3 μm or thereabout and then accumulating them on a conveyor to form non-woven fabrics. They are used mainly for air filters. However, filaments constituting the melt blown non-woven fabrics have lower strength than usual non-drawn fibers as 0.1 cN/dtex or thereabout, in which a number of small lumps of resins called as shots or wads are present. The non-woven fabrics consisting of the drawn sheath-core type filaments of this invention have strength equal with or superior to that of usual synthetic fibers while having a diameter of about 3 μm or thereabout like the melt blown non-woven fabrics because the sheath-core type filaments are highly oriented. And it is possible to prepare non-woven fabrics without containing shots and wads at all and to be non-woven fabrics having high functions by further consisting of the hollow filaments and the conjugate filaments.

Non-woven fabrics of this invention, adding to effects of being fine texture, and improved luster and printability by being the super microfilaments, these can also have characteristics of light weight, heat insulation, thermal retention, water repellency and the like by consisting of the hollow filaments and adhesiveness, distinctive touch, bulkiness and so on by consisting of the conjugate filaments. Non-woven fabrics usually require any interlacing or entwining among fibers. However, in this invention, since the diameter of filaments are extremely small, the number of the sheath-core type filaments per unit weight is extremely increased and the sheath-core type filaments are interlaced by vacuum suction below the conveyor and there are many cases that simple pressing upon accumulation of the sheath-core type filaments on the conveyor is sufficient, with no particular interlacing or entwining process like melt blown non-woven fabrics. Naturally, methods such as thermal embossing, needle punching or adhesive bonding conducted in usual non-woven fabrics may also be used, which may be selected depending on the application use. In the filter usage as a major application use of super micro fiber non-woven fabrics, collecting efficiency can be increased outstandingly by applying electrostatic treatment to the non-woven fabrics and non-woven fabrics of this invention can also be applied by electrostatic treatment to the field of the filters. When filaments are accumulated on the conveyor in the manufacture of the non-woven fabrics of this invention, negative pressure is applied at the back of the conveyor and the flow of air under air suction by negative pressure or the flow of air by the positive use of an air sucker sometimes acts as tension for drawing in the sheath-core type filaments drawing, which is also included in the drawing tension of this invention.

In the drawn sheath-core type filaments of this invention, the drawn filaments can also be provided in the form of connected to the un-drawn filaments. The filaments of this form are especially preferable in a batch method although may be provided in a continuous method. And, as materials for filaments, the optical filaments and the micro-porous-film hollow filaments are especially preferred. By being the drawn filaments connected to the un-drawn filaments in the optical filaments, these enable to hit strong light on a pin point collecting light from larger area, and as these can be used when light of a light source is weak, so it is useful for a fiberscope and the like. Usually, in such cases, a connecting device is necessary between a light condensing device and the optical filaments but there are defects that the connecting is difficult and the device is expensive when filaments are fine. Also when the un-drawn portion is connected to the drawn micro-porous-film hollow filaments, supplying portion of gasses and the like are large that the gasses and the like are supplied at these portion simply and conveniently and there is an advantage to be able to supply gases continuously thereafter to the micro-porous-film hollow super microfilaments without the need of any connecting devices. Yet, filaments in this form that the original filaments are connected to the drawn sheath-core type filament can be obtained by taking out products that the original filaments are connected to the drawn filaments state by stopping the infrared beam irradiation during the drawing. In this case, the connecting refers to continuously unified status without using adhesive and other means.

Still, the draw ratio (λ) in this invention is represented by the following equation based on the diameter $d_o$ for the original filament and the diameter d for the filament after drawing. In this case, calculation is performed assuming the density of filament as constant. The diameter measurement of the filament is conducted by a scanning electron microscope (SEM) based on photograph taken at 100×, 350× or 1000×, with respect to average values for 10 points.

$$\lambda=(d_o/d)^2$$

Advantageous Effects of the Invention

In this invention, concerning the sheath-core type filaments such as hollow filaments, optical filaments, conjugate filaments and etc., it was possible to obtain the super microfilaments easily by simple and convenient means without requiring the special, high-accuracy and high-level devices. These sheath-core type hollow super microfilaments are realized by the super high draw ratio of 100 times or more and enabling to provide the methods to realize such high ratio drawing mean not only the sheath-core type super microfilaments can be obtained simply and conveniently but also possible to produce the hollow super microfilaments at high speed that the significance from a productivity side is large.

When the sheath-core type super microfilaments by this invention are the hollow filaments, adding to the property of light weight, thermal retention, heat insulation and the like that the hollow filaments have, being the super microfilaments the texture is fine, luster and printability are improved and further shall be high-grade and high-quality. The hollow filaments are used for swim wear in recent years; the properties of thermal retention, floating on water and uneasiness to see-through are utilized. By making these to the super microfilaments, the commercial value is increased by being fine texture, increasing the water repellency also and improving the luster and the printability. If the hollow filaments are the hollow filaments for the dividual fibers, the finer filaments may be manufactured and are hollow filaments with the cross section of complicated shape. In a case that the hollow filaments are the micro-porous-film hollow filaments, separation efficiency is improved as the film thickness is thinned by drawing. And, as the shape of pores is thinner and longer, and finer by drawing that separation efficiency can be improved. Further, because the un-drawn parts are connected to these drawn micro-porous-film hollow filaments, supply of raw material gas and the like is easy as a supplying portion and so on of gas is large and the connection to the micro-porous-film hollow super microfilaments is possible without need of any special connecting device that the device is not expensive and it was possible to make the device compact.

In a case that sheath-core type super microfilaments of this invention are optical filaments, point by point resolution is increased by using for an image sensor and this leads to an improvement of performances of the sensor and diagnosis equipment. Also, as it is super microfilaments, fiber bundles are flexible and thin flat that it is possible to make the equipment compact. Moreover, since un-drawn portions are connected to these drawn optical filaments, strong light can hit on a pinpoint condensing light in a large area and performances as a fiberscope and the like are improved. Also, these were optical filaments that the efficiency of condensing light is good even light of a light source is weak. And, conventionally connection of condensers and optical filaments were difficult because filaments were fine. But, in this invention since drawn filaments and un-drawn portion are connected, there is no need of the connecting portion and as an expense for the connecting device is also unnecessary that the cost is reduced and the devices is compact.

When the sheath-core type super microfilaments of this invention are the conjugate filaments, the performances as adhesive filaments, absorbent filaments and the crimp filaments of the conjugate filaments are further improved by filaments are super-micro, and are high-grade and high-quality.

Moreover, long fiber non-woven fabrics consisting of the hollow super microfilaments and the conjugate super microfilaments could be manufactured according to this invention. There are melt blown non-woven fabrics as non-woven fabrics consisting of the sheath-core type super microfilaments which are on the market but the filaments have not sufficient strength and there were problems to mingle with small lumps of resins called a shot or a wad. However, the non-woven fabrics of this invention have no such defects and make the non-woven fabrics higher in grade and higher in quality, cooperating together the characteristics such as thermal retention and light weight that hollow filaments have, the properties of adhesiveness, bulkiness and moisture absorbency that the conjugate filaments have and the quality of fineness of texture, gloss and improved printability that super microfilament have.

4. BRIEF DESCRIPTION OF THE DRAWINGS

FIGS. 6A, 6B, and 6C show schematic views of various blowing ducts used in this invention.

Figure 7:
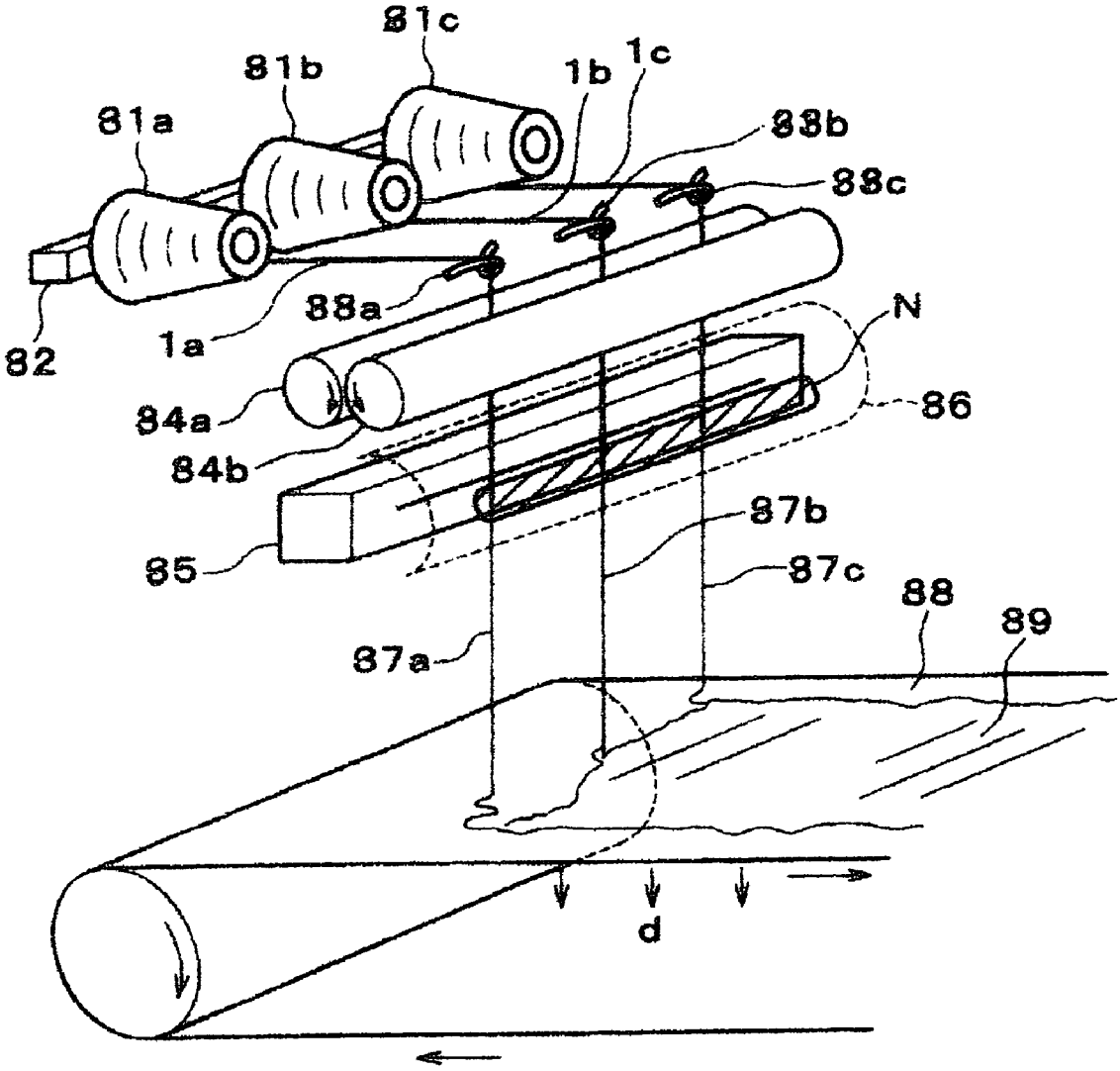

FIG. 7 shows a schematic diagram of the process manufacturing non-woven fabrics consisting of the drawn sheath-core type filaments of this invention.

FIG. 8 shows a graph for the experimental results of variation between outside diameters and inside diameters of the filaments according to drawing of the hollow filaments of this invention.

Figure 9:
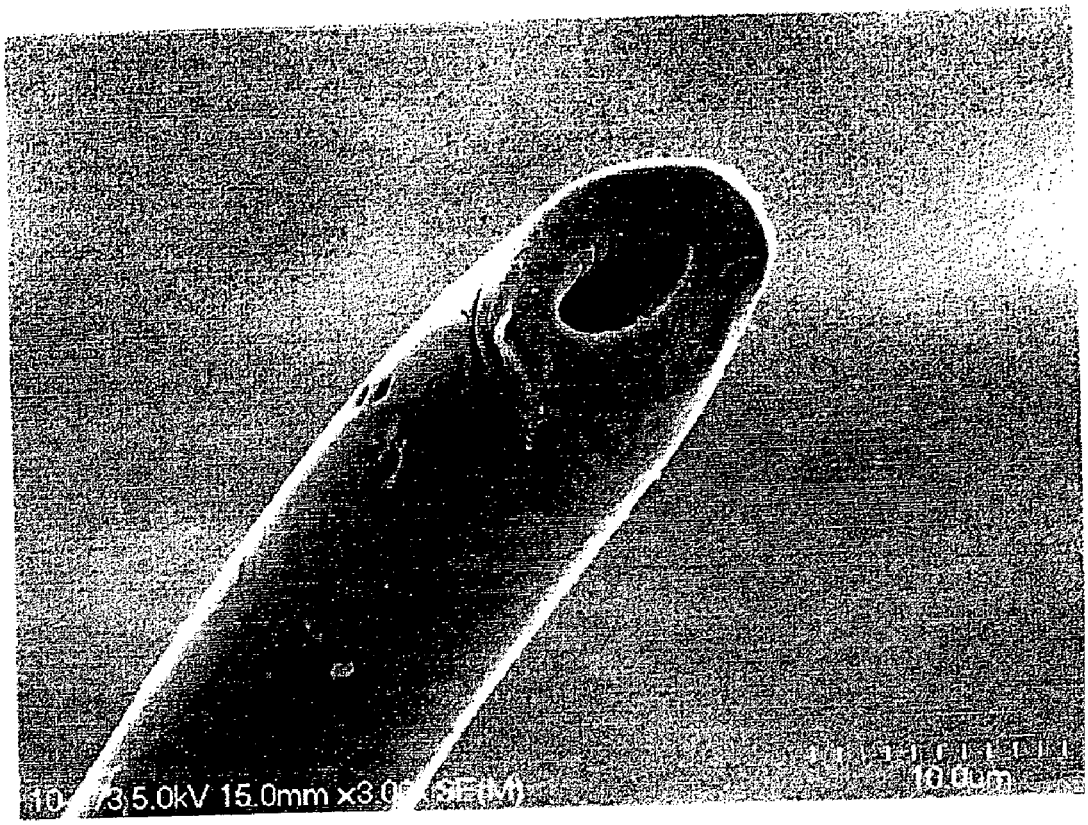

FIG. 9 shows a scanning electron microscope photograph (1000×) of the drawn hollow filaments of this invention.

FIG. 10A is a polarizing microscope photograph of the drawn hollow filaments of this invention shown by a photograph (100×) of a drawing starting point.

FIG. 10B is a polarizing microscope photograph of the drawn hollow filaments of this invention shown by a photograph (100×) of the drawn filaments.

5. DESCRIPTION OF THE PREFERRED EMBODIMENTS

Figure 1:
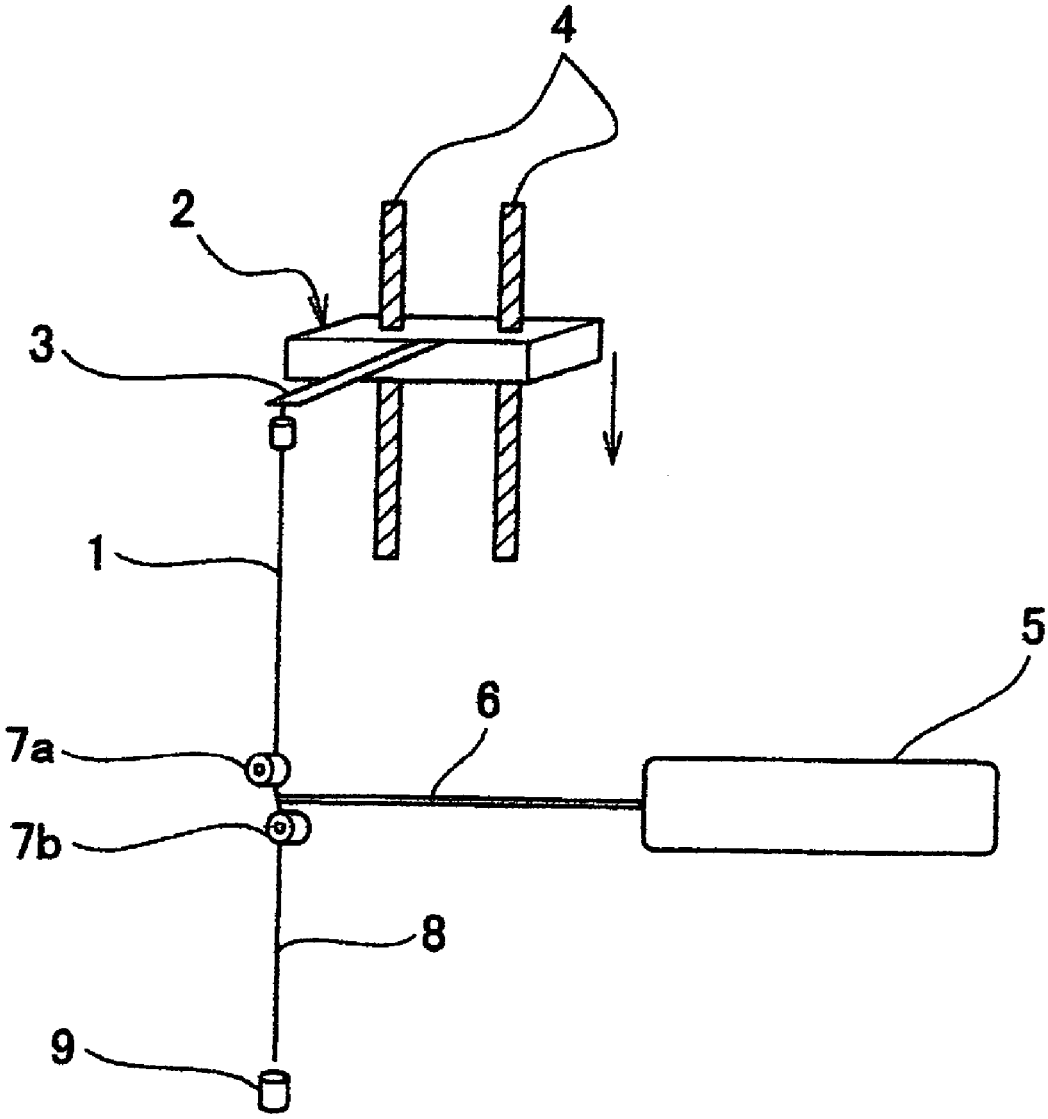
FIG. 1 shows a schematic view of the process manufacturing the drawn sheath-core type filaments of this invention in a batch method.

In the following, the examples of modes to carry out this invention are described based on the drawings. FIG. 1 shows an example of the apparatus in the batch method of this invention. The original sheath-core type filaments 1 are gripped by a gripper 3 fixed on a transfer device 2 moved by rack-and-pinion method. According to a guide rail 4 consisting of a spiral screw moves downward at a constant speed by rotation of a motor, the original filament 1 moves downward at a constant speed. A laser beam 6 from a continuous carbon dioxide gas laser emitter 5 is adapted to irradiate a specific position of the moving original filaments 1. In the drawing, to constantly keep stable the infrared irradiation position of the original filament, tackles 7*a*, 7*b* are provided to up-and-down of the infrared beam irradiation position of the original filaments and disposed to guide the original filaments. The original filaments irradiated infrared rays are drawn by the own weight or a tension of 10 MPa or less and shall be the drawn sheath-core type filaments 8. The drawn sheath-core type filaments 8 are added a load 9 if necessary or wound-up by a winding reel. Moreover, the drawing tension may be measured simply and conveniently by using the gripper 3 as a chuck of a tension tester that is directly connected to a load cell of a tension tester. The batch method of FIG. 1 is especially useful when obtaining filaments connected the original sheath-core type filaments with the drawn filaments.

Figure 2:
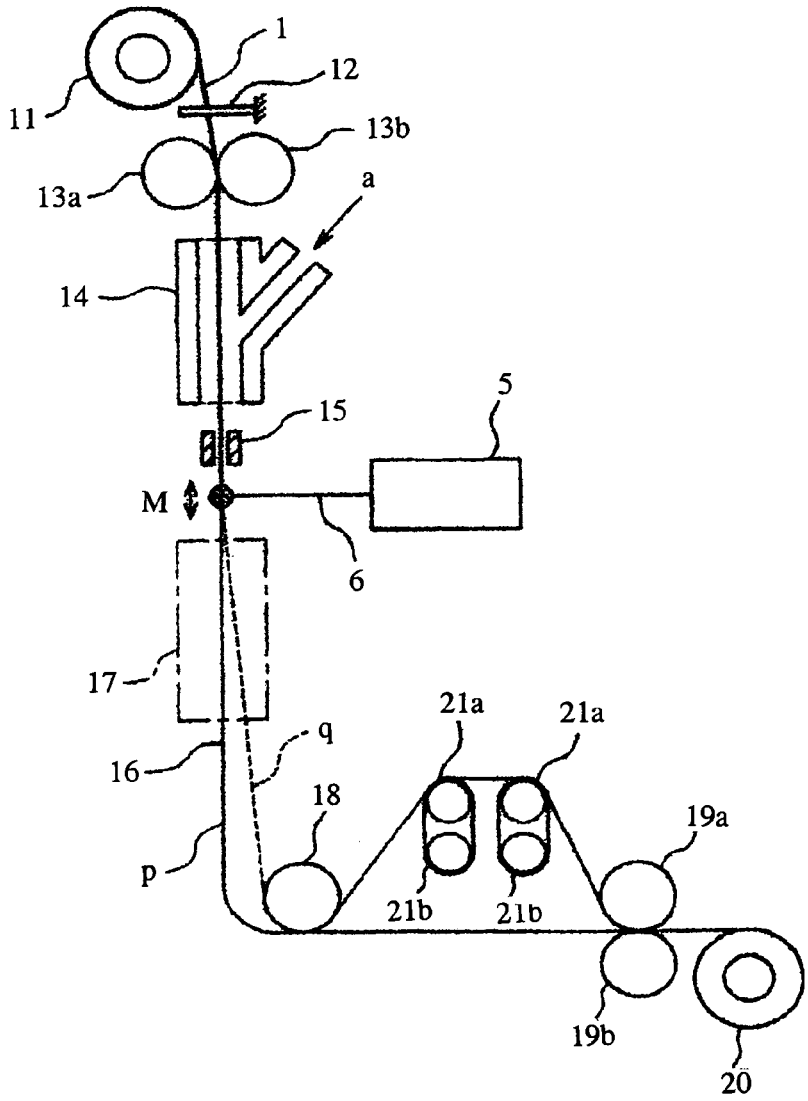
FIG. 2 shows a schematic view of the process manufacturing the draw sheath-core type filaments in a continuous method.

FIG. 2 shows an example of a process for the continuous method of this invention. The original sheath-core type filament 1 is reeled off from a state of wound around a reel 11, passed by way of a comb 12 and delivered at constant speed from reel off nip rollers 13*a* and 13*b*. The delivered original filament 1 is sent by a blowing duct 14 and then falls down at a constant speed while being regulated for the position by a guiding tool 15. The blowing duct 14 adapted such that air guided along arrow "a" is introduced to a channel of the original filament 1 and the filament is sent by flow of air. Still, the use of the blowing duct 14 can also be omitted. The guiding tool 15 is used for accurately determining the laser irradiation position and the running position of the filament. While a hypodermic needle with an inner diameter 0.5 mm was used in the drawing, a narrow pipe, a comb or snail-wire shown in FIG. 7 can also be used. A laser beam 6 is irradiated to a zone heater M of a predetermined width by a laser emitter 5 to the running original filament 1 just below the guiding tool 15. The filament is heated by the laser beam 6 and drawn by the tension given by the own weight of the filament and the velocity of flow of air delivered from the blowing duct, and falls down as a drawn sheath-core type filament 16 and is preferable to pass through a heat treatment zone 17 formed in the falling path. The drawn sheath-core type filament 16 passes along a tackle 18 and then wind-up by way of take-up nip rollers 19*a* and 19*b* around a wind-up reel 20. In this case, the channel of the drawn sheath-core type filament 16 to the tackle 18 includes a case where it is drawn as a trace "p" of a free falling of the filament, a case where it is drawn as a linear trace "q" to the tackle 18 and a case where it is drawn as an intermediate trace thereof. In a case where it is drawn by the own weight of the drawn sheath-core type filament 16 in the trace "p", the flow of air from the blowing pipe 14 is sometimes added to the drawing tension, which is also included within a category of drawing by own weight. In the trace "q" and at the intermediate position of the trace "p" and trace "q", the wind-up tension exerts on the drawing tension in which the drawing tension is preferably 10 MPa or less. The drawing tension may be measured by a tension measuring mechanism disposed to the tackle 18 but as an another method, it can be estimated based on the relation of the same supplying speed, the laser irradiation condition and the draw ratio by the load cell measurement of above batch method. Before wind-up around the take-up and wind-up reel 20, the filament can be further drawn between the heated drawing rolls 21*a*, 21*b* and the drawing rolls 22*a* and 22*b* by a speed ratio of the drawing rolls 21 and 22. The heat treatment zone 17 for the drawn sheath-core type filament in this case is preferably disposed subsequent to the drawing roller 22. Also, when the plural original filaments are drawn simultaneously, it is preferable to have been air interlaced among filaments by a interlace method and the like just before the take-up reel.

Figure 3:
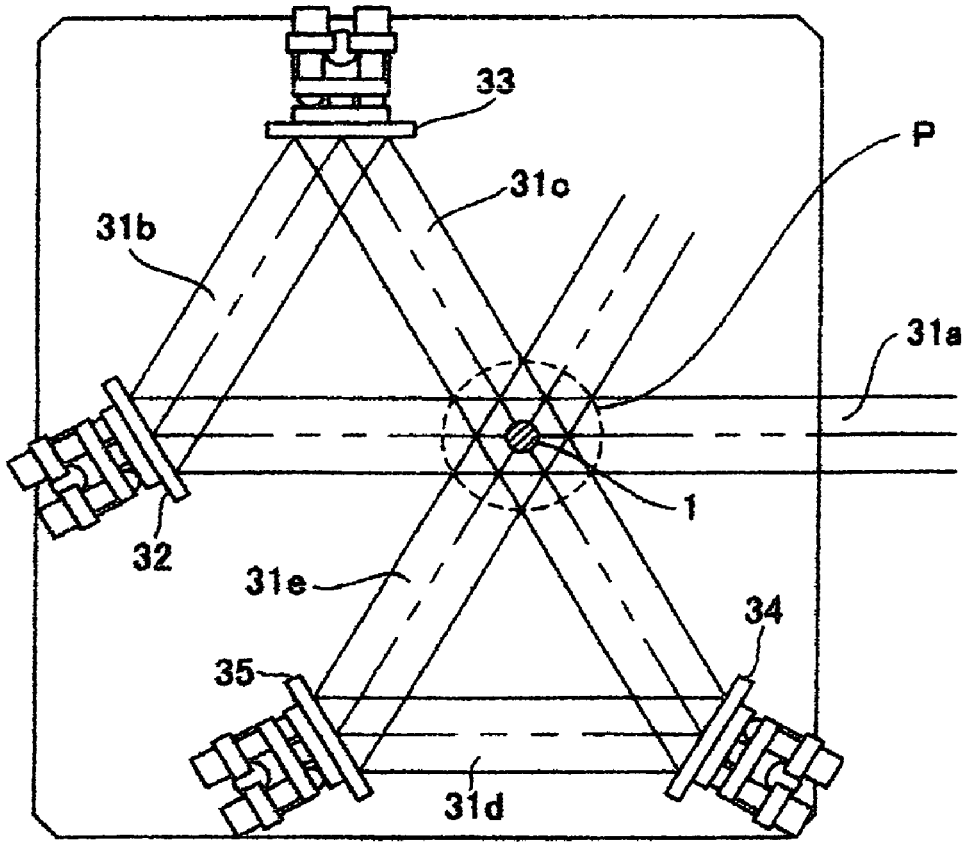
FIG. 3A shows a plain view of an example of mirror arrangement to irradiate the infrared beams from plural directions to the original sheath-core type filaments of this invention.
FIG. 3B shows a side view of an example of mirror arrangement to irradiate the infrared beams from plural directions to the original sheath-core type filaments of this invention.
Figure 3:
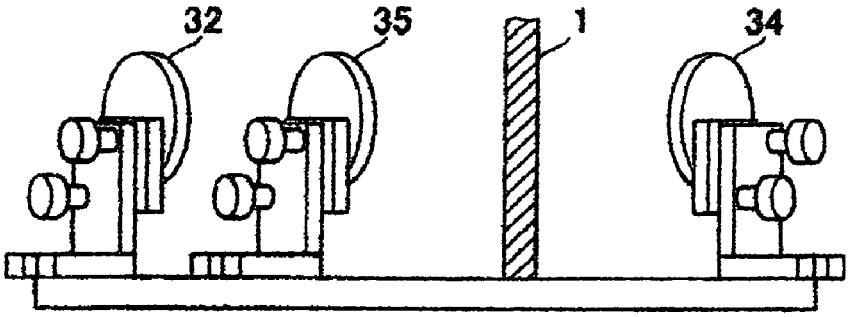

FIG. 3 shows an example of means to irradiate the infrared beam adopted in this invention to the original filament from the plural directions. FIG. 3A is a plain view and 3B is a side view. The infrared beam irradiation to the original filament from the plural directions like this drawing is also conducted in FIGS. 1 and 2, but is omitted to show in FIGS. 1 and 2 as it is complicated and shown representatively in FIG. 3. The infrared beam 31*a* irradiated from the infrared emitter reaches the mirror 32 through the region P (inside a dotted line in the drawing) where the original filament 1 passes through and is the infrared beam 31*b* reflected by the mirror 32, and is the infrared beam 31*c* reflected by the mirror 33. The infrared beam 31*c* irradiates the original filament through the region P from 120 degree behind of the first irradiation position of the original filament. The infrared beam 31*c* passed through the region P is the infrared beam 31*d* reflected by the mirror 34, which is the infrared beam 31*e* reflected by the mirror 35. The infrared beam 31*e* irradiates the original filament 1 through the region P from an opposite 120 degree behind direction of foregoing infrared beam 31*c* against the first irradiation position of the original filament. Thus, the original filament 1 can be equally heated from the symmetrical position 120 degree apart by the three infrared beams 31*a*, 31*c* and 31*e*.

Figure 4:
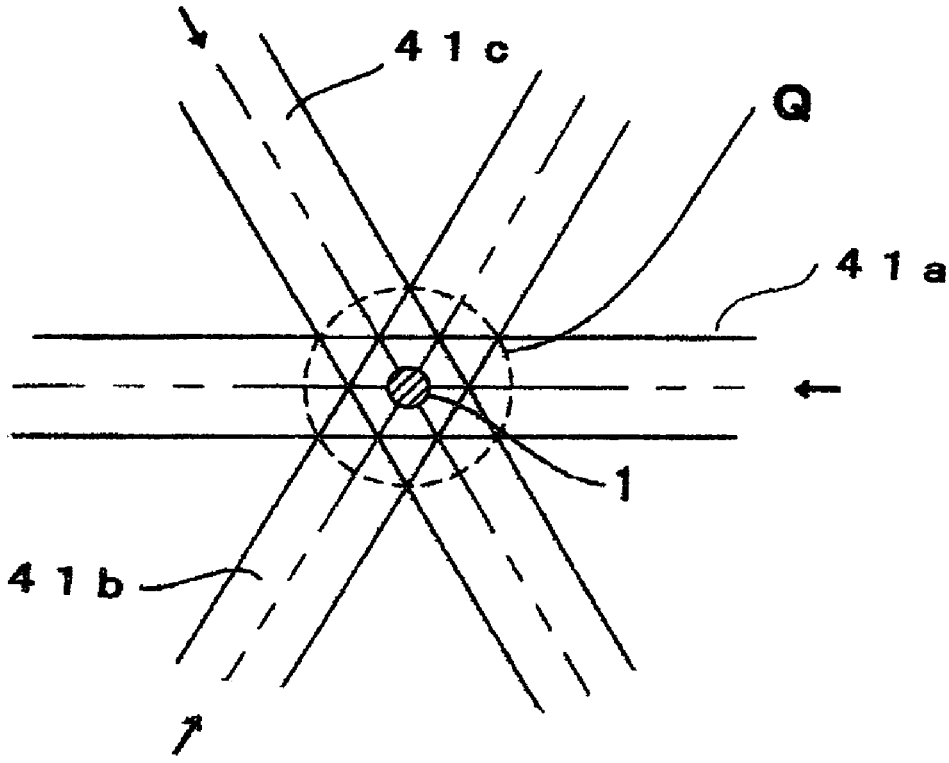
FIG. 4 shows a plain view of the other example to irradiate the infrared beams from the plural directions to the original filaments in case of having plural light sources.

In FIG. 4, the other example of the means adopted in this invention to irradiate the infrared beams from the plural directions that is an example of using plural light sources is shown in a plain view. The infrared beam 41*a* radiated from the infrared emitter is radiated to the original sheath-core type filament 1. And the infrared beam 41*b* radiated from the other infrared emitter is also radiated to the original sheath-core type filament 1. Further, the infrared beam 41*c* radiated from the other infrared emitter is also radiated to the original sheath-core type filament 1. Thus, the radiation from the plural light sources can be the high power light sources using the plural laser emitters which are relatively small light sources and are stable and not expensive. Still, a case using 3 light sources are shown in the drawing but 2 are possible and 4 or more can also be used. Especially, when drawing the plural filaments, drawing by using the plural light sources like these is particularly useful.

Figure 5:
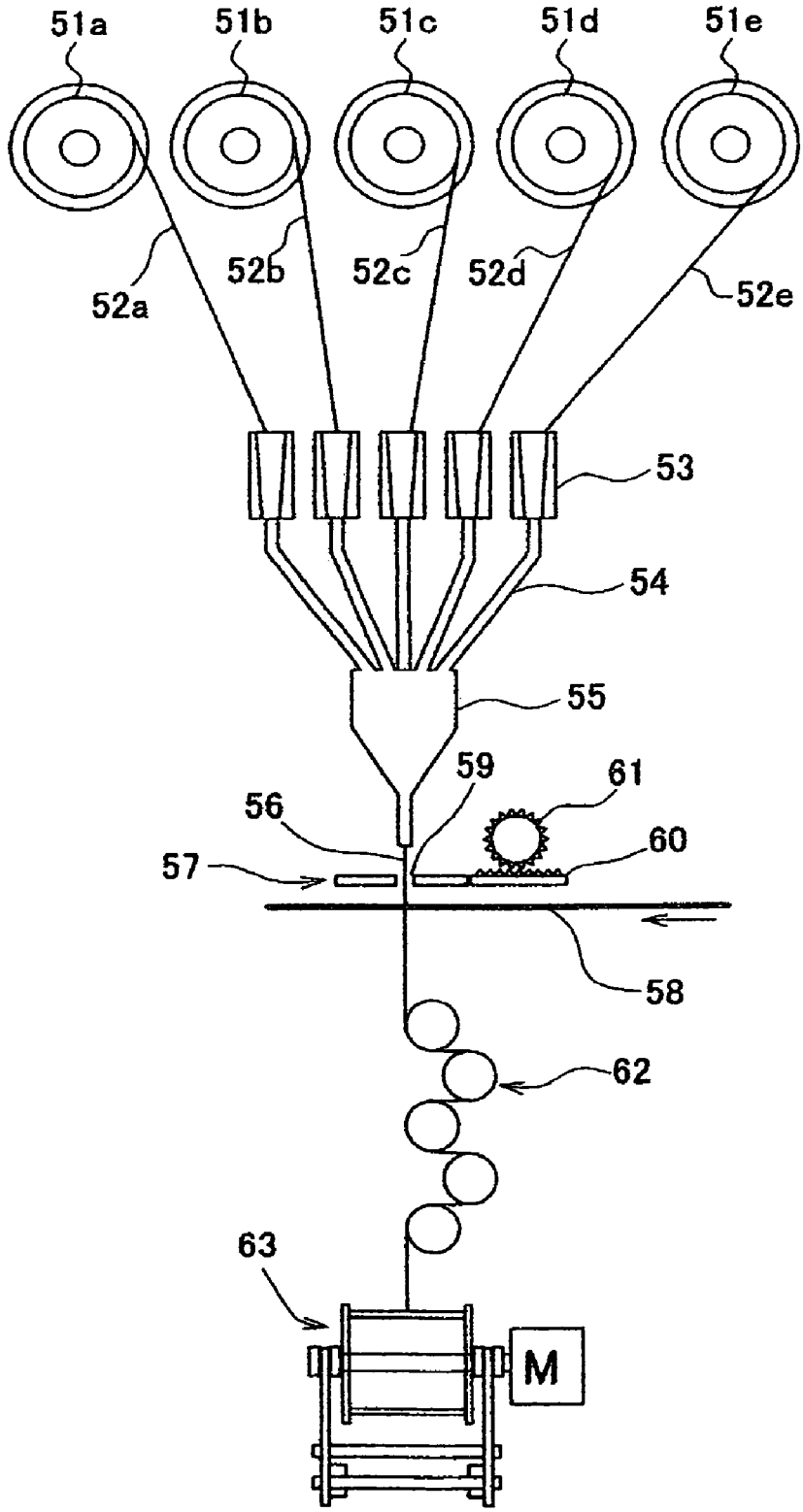
FIG. 5 shows a schematic view of a process in case of re-drawing plural numbers of the drawn sheath-core type filaments of this invention.

In FIG. 5, there is shown an example of the sheath-core type filaments already drawn by this invention are reeled off the plural number at the same time and drawing simultaneously. The drawn sheath-core type filament 52*a*, 52*b*, 52*c*, 52*d* and 52*e* wound-up around the bobbins 51*a*, 51*b*, 51*c*, 51*d* and 51*e* are each delivered through the blowing duct 53 and the pipe 54 and are gathered in an air manifold 55, and is filaments assembly 56. Still, the sheath-core type filament 52 in the blowing duct 53 and the pipe 54 is not shown in the drawing as is complicated. It is preferable that the bobbins 51 are lowered the reel off tension by rotating at the constant speed because the un-drawn original filament has a low tensile strength and Young's modulus, and fineness of the drawn filament 52 is small that they can not resist the tension. The delivered filaments assembly 56 is adjusted a running position to be the center of laser beam by a variable pitch mechanism 57. A guiding tool 59 shall preferably guide separately the filaments for not to contact the filament each other at a drawing point. A variable pitch mechanism 57 is provided with the guiding tool 59 and the running position of filaments are finely adjusted the position by a rack 60 and a gear 61. As for the variable pitch mechanism 57, an example to adjust in one direction is shown in the drawing but can be adjusted in XY axis directions by providing a set of gears in a right angle. The filaments assembly 56 adjusted the position by the variable pitch mechanism 57 is heated by the laser beam 58 and drawn, and adjusted to the constant take-up speed by take-up mechanism 62 and wound-up to the wind-up bobbin 63 driven by a motor M. In this drawing the laser beam is shown by one line but is preferably the plural beams shown in FIGS. 3 and 4. And, an example of wind-up directly around bobbins is shown in the drawing but it is preferable to wind-up adding twisting and intertwining among the filaments by the interlacing and the like. Also, an example of re-drawing by the infrared beam is shown in FIG. 5 but the re-drawing can use also the other drawing means of ordinary roller drawing, zone drawing and so on. Still, the air introduced to the blowing duct 53 and the pipe 54 is guided to a channel of the original filament 1 and the filament is delivered by the flow of air, and the tension given by the wind velocity delivering air is added to the drawing tension of this invention. Yet, FIG. 5 is described as an example of re-drawing of the drawn filament but used also as the means for the plural numbers drawing of the un-drawn original filaments with the similar mechanism.

Figure 6:
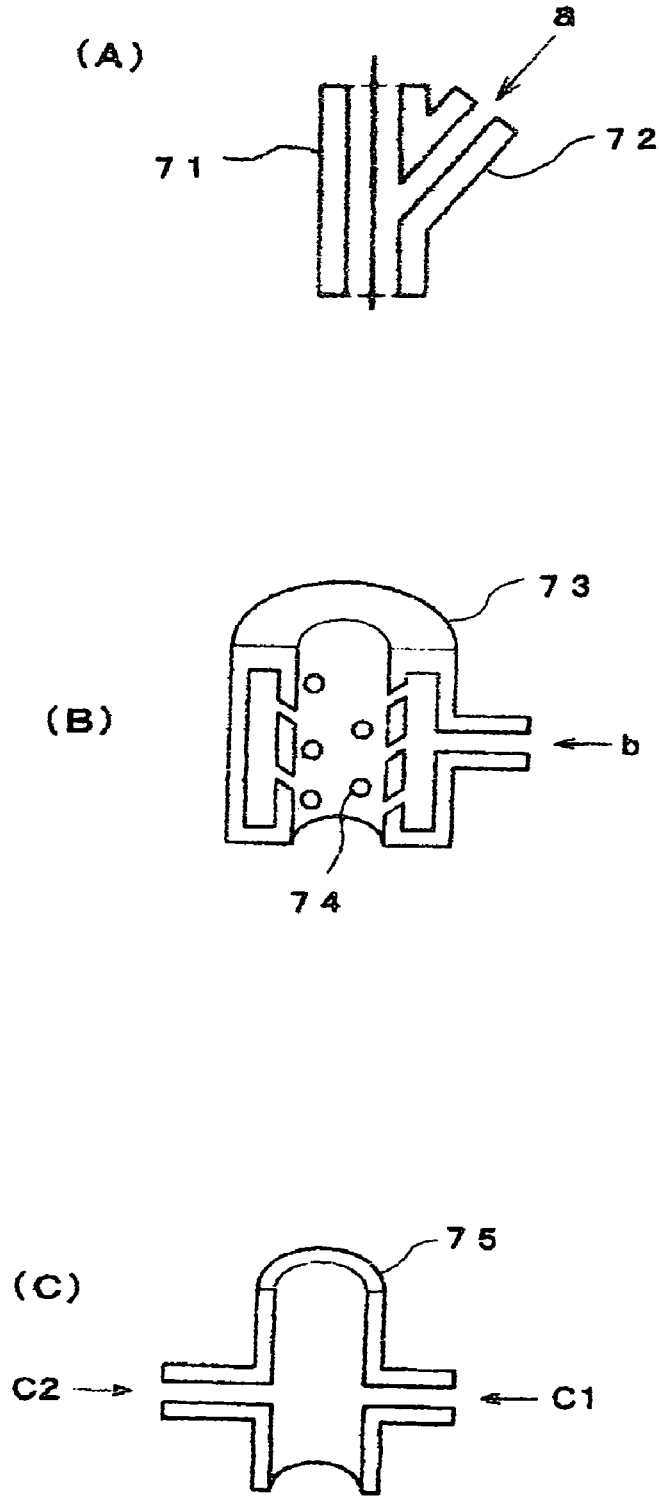

FIG. 6 shows examples of various blowing ducts adopted in this invention. In FIG. 6A, air introduced from the arrow "a" through branched duct 72 joins to a main duct 71 where the filament 1 passes through. FIG. 6B shows a double walled duct 73 in which the inside is hollow and air introduced along an arrow "b" is guided through a number of apertures 74 perforated in the inner wall of the double walled duct to the channel of the filament. FIG. 6C shows an example of a nozzle used as an air interlace nozzle 75 used for interlace spinning in which the air is blown from both sides' c1 and c2. Thus, the reason why the air is actively delivered to the running direction of the filaments is not to disturb the running of filament by the resistance of the guiding tool as the drawing tension is small in this invention and it is also possible to add the drawing tension by the momentum of the air when adding the tension actively with the wind-up tension is not possible such as in a case of manufacturing non-woven fabrics. Also, the nozzle in FIG. 6C can be used at the time of interlace winding after drawing of this invention. Yet, the blowing ducts in FIG. 6 show the examples of the tubular shape but a grooved shape which is partially opened is also used.

FIG. 7 shows an example of manufacturing non-woven fabrics of this invention. Multiplicity of the original sheath-core type filaments 1 is attached to a rack 82 in a state wound around bobbin 81 (for avoiding complexity, only three filaments are shown). These original sheath-core type filaments 1*a*, 1*b* and 1*c* are delivered through snail wires 83*a*, 83*b* and 83*c* as the guiding tool by the rotation of supply nip rolls 84*a* and 84*b*. The supplied original sheath-core type filaments 1 are heated in the course of falling by the own weight, by line infrared beams emitted from an infrared emitter 85. The range for the heating portion "N" by the infrared beams in the running process of the original sheath-core type filaments 1 is shown by hatched lines. Beams passing through the original sheath-core type filaments 1 with no absorption are reflected at a concave mirror 86 shown by dotted line and then returned to be condensed to the heating portion "N". A concave mirror is disposed also on the side of the infrared emitter 85 (in this case, the beam traveling portion from the infrared emitter has an open window), which is not illustrated in the drawing. The original sheath-core filaments 1 are heated by radiation heat of infrared rays at the heating portion "N", drawn by the own weight of filaments per se by portion there below and formed into drawn sheath-core type filaments 87*a*, 87*b* and 87*c*, which are accumulated on a running conveyor 88 to form a web 89. Air is sucked in the direction of an arrow "d" by vacuum suction from rear face of the conveyor 88 to contribute to the stability of running of the web 89. The web is pulled by the tension of the negative pressure "d" exerting on the drawn sheath-core type filament 87 to contribute to the improvement of attenuation and orientation degree of the sheath-core type filaments and such tension is also regarded as a portion of the tension caused by the own weight in this invention. Although not illustrated in the drawing, a number of bobbins 81 for the original sheath-core type filaments 1 are provided in a multi-stage along the running direction of the conveyor 88, and nip rolls 84 and infrared emitters are provided in a multi-stage to improve the productivity of the web 89. In case of providing the supply nip rolls 84 in the multi-stage along the running direction the infrared emitter 85 and the concave mirror 86 can also be utilized for several stages. Yet, in a case that drawing and orientation are small since the drawing tension by the own weight of the filaments and the negative pressure from rear face of the conveyor is not sufficient, guiding the filaments by blowing duct when the original filaments 1 are guided to the infrared beam portion, the tension given by the air delivering wind velocity of the blowing duct is also added and used.

EXAMPLE 1

Figure 10:
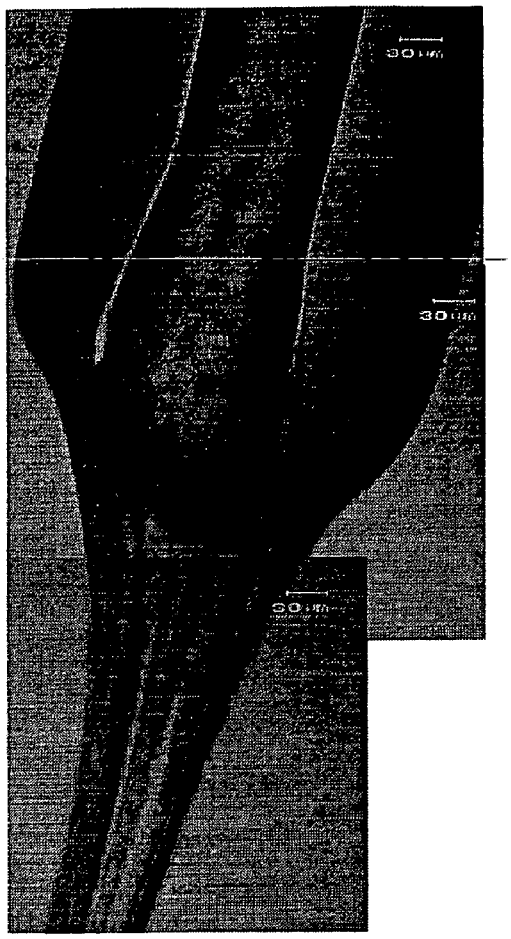
Figure 10:
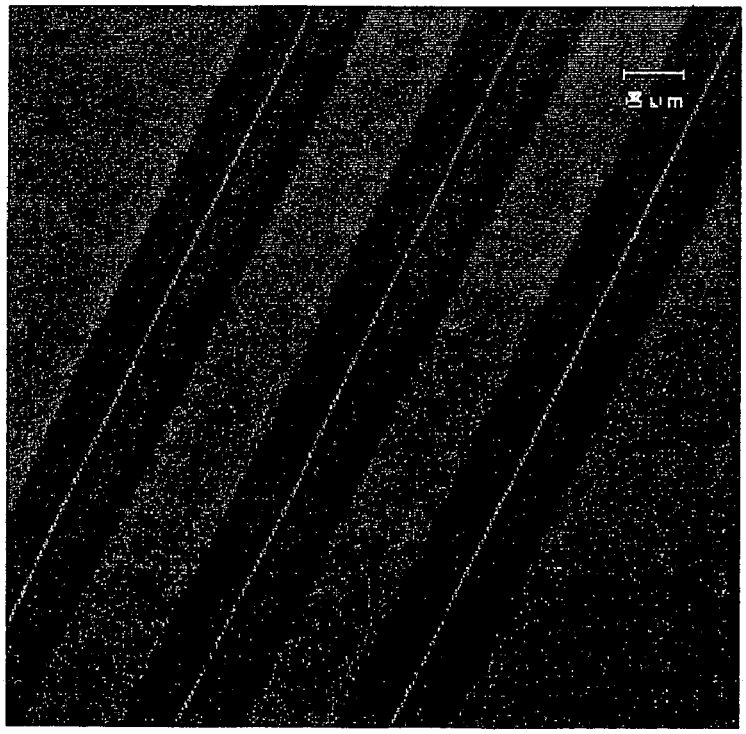

Isotactic (it) polypropylene hollow filaments (filament diameter 280 μm, inside diameter 90 μm) were used as the original sheath-core type filaments. These filaments were drawn by the drawing apparatus shown in FIGS. 2 and 3. The experimental results for the filament diameter (outside diameter) and the inside diameter of obtained filaments by changing the supplying speed of the original filaments variously and also the wind-up speed were shown in FIG. 8. In this case, a carbon dioxide gas laser emitter manufacture by Onizuka Glass Co., Ltd. with a maximum power of 10 W was used for the laser emitter. The laser power density was 28.5 W/cm$^2$ (1.2 W) at a supplying speed of 0.3 m/min and as the supplying speed was increased the power density was increased, and was 52.5 W/cm$^2$ (2.2 W) at 0.6 m/min. The laser beam diameter in this case was 4.0 mm. The drawn sheath-core type filaments run along the trace "p" in FIG. 2 and the distance from the laser heating portion M to lowermost position was 120 cm. As shown in FIG. 8, the draw ratio of 100 times or more was obtained easily even at a winding speed of 84.8 m/min, also the diameter, (outside diameter) of the drawn filaments reached 7 μm finally and the drawing ratio, too, exceeded 10,000 times. When comparing the ratio of the outside diameter and inside diameter, if the supplying speed was low the inside diameter was relatively large even the filament diameter was small, and if the supplying speed was high the inside diameter tended to be small. In FIG. 9, a scanning electron microscope (SEM) photograph of the thus drawn hollow filament was shown. Also, regarding the sample of this drawing process was shown in FIG. 10 by a polarizing microscope photograph to understand the outside diameter and inside diameter. FIG. 10A showed the drawing starting portion, in this example the diameter of the drawing starting portion was enlarged although slightly at the drawing start portion. FIG. 10B showed a photograph of the polarizing microscope of the drawn hollow filaments with the outside diameter of 9 μm (draw ratio was approximately 850 times). When wide angle x-ray diffraction patterns of the drawn filaments were taken, an orientation pattern was clearer than the original hollow filaments that it was understood the orientation was not disturbed by drawing but orientation was rather improved.

EXAMPLE 2

Poly(methyl methacrylate) series optical filaments (filament diameter 250 μm) as the original sheath-core type filaments were drawn at a supplying speed of 0.3 m/min by the similar means to Example 1. It was conducted with a power density of 23.9 W/cm$^2$. In this case, the drawn filaments with a filament diameter of 14 μm (draw ratio 319 times) at a winding speed of 139.8 m/min, the filament diameter of 12 μm (draw ratio 433 times) at a winding speed of 226.2 m/min and the filament diameter of 7 μm (draw ratio 1274 times) at a winding speed of 400 m/min were obtained. When the drawing tension corresponds to each of these drawing ratios were measured by the load cell according to the method shown in FIG. 1, they were 0.12 MPa at a filament diameter of 14 μm, 0.18 MPa at the filament diameter of 12 μm and 0.25 MPa at a filament diameter of 7 μm. Still, drawing of the high drawing ratio of 100 times or more was not possible under the tension of more than 10 MPa. Also, the drawing of the high ratio was not possible even with the low drawing tension of less than 0.001 MPa.

6. INDUSTRIAL APPLICABILITY

By making the sheath-core type super microfilaments by the simple and convenient drawing means from the sheath-core type filaments such as the hollow filaments, the optical filaments and the conjugate filaments, the non-woven fabrics and the like consisting of good thermal retaining clothes, super micro optical fibers and conjugate filaments can be manufactured.

The invention claimed is:

1. An apparatus for manufacturing drawn sheath-core filaments comprising a blowing duct supply device for delivering original sheath-core filaments, an infrared ray heating device capable of heating within up-and-down 4 mm in the axial direction of the original filaments at the center of the original filaments by means of infrared beams radiated from plural directions, a guiding tool for controlling the position of the original sheath-core filaments and positioned between the blowing duct and the infrared heating device, and further having means for controlling the draw ratio of the heated original sheath-core filaments at 100 times or more by providing a tension of 10 MPa or less.

2. The apparatus for manufacturing drawn sheath-core type filaments according to claim 1, wherein said infrared beams are provided by at least one laser emitter.

3. The apparatus for manufacturing drawn sheath-core type filaments according to claim 1, wherein the infrared beams radiated from a plurality of directions are reflected infrared beams originally emitted in a single direction from a single source and reflected by a system of mirrors to radiate the original sheath-core filaments from a plurality of directions.

4. The apparatus for manufacturing drawn sheath-core-type filaments according to claim 1, wherein a radiation means from plural directions of said infrared beams are the beams from plural infrared beam emitters.

5. The apparatus for manufacturing drawn sheath-core type filaments according to claim 2, wherein said laser beam is a carbon dioxide gas laser having a power density of 10 W/cm$^2$ or more.

6. The apparatus for manufacturing drawn sheath-core type filaments according to claim 1, wherein said guiding tool has a position control device which can finely adjust the guiding position of said original sheath core filaments.

* * * * *